US010108213B2

(12) United States Patent
Yang et al.

(10) Patent No.: US 10,108,213 B2
(45) Date of Patent: Oct. 23, 2018

(54) THREE-DIMENSIONAL POWER STAGE AND ADAPTIVE PIPELINE CONTROL

(71) Applicant: The Hong Kong University of Science and Technology, Hong Kong (CN)

(72) Inventors: Fan Yang, Hong Kong (CN); Kwok Tai Philip Mok, Hong Kong (CN)

(73) Assignee: The Hong Kong University of Science and Technology, Hong Kong (CN)

( * ) Notice: Subject to any disclaimer, the term of this patent is extended or adjusted under 35 U.S.C. 154(b) by 0 days.

(21) Appl. No.: 15/736,894

(22) PCT Filed: Jun. 13, 2016

(86) PCT No.: PCT/CN2016/085522

§ 371 (c)(1),
(2) Date: Dec. 15, 2017

(87) PCT Pub. No.: WO2016/202223

PCT Pub. Date: Dec. 22, 2016

(65) Prior Publication Data

US 2018/0173262 A1 Jun. 21, 2018

Related U.S. Application Data

(60) Provisional application No. 62/230,803, filed on Jun. 16, 2015.

(51) Int. Cl.
*G05F 1/575* (2006.01)
*G05F 1/563* (2006.01)

(52) U.S. Cl.
CPC ..... *G05F 1/575* (2013.01); *G05F 1/563* (2013.01)

(58) Field of Classification Search
CPC ..... G05F 1/575
See application file for complete search history.

(56) References Cited

U.S. PATENT DOCUMENTS 4,056,732 A 11/1977 Martin
4,109,194 A 8/1978 Miller
(Continued)

FOREIGN PATENT DOCUMENTS

CN 101111811 A 1/2008
CN 104300788 A 1/2015
(Continued)

OTHER PUBLICATIONS

Bentley, et al., "Identification and improved control of GTAW voltages utilizing digital series compensation," *IEEE Conference on Decision and Control including the Symposium on Adaptive Processes*, pp. 1050-1057, 1980.
(Continued)

*Primary Examiner* — Timothy J Dole
*Assistant Examiner* — Ishrat Jamali
(74) *Attorney, Agent, or Firm* — Leydig, Voit & Mayer, Ltd.

(57) ABSTRACT

A digital linear voltage regulator includes a power stage (208), arranged in a hierarchical grouping of power stage units. The power stage (208) is configured to deliver power to a load (212). The digital linear voltage regulator further includes a mixed-signal controller (206), configured to control each power stage unit in the power stage (208) by conditionally adjust a number of active power stage units in the power stage (208) based on a comparison of a feedback voltage of the load (212) and a reference voltage; wherein the hierarchical grouping of power stage units comprises N levels; wherein the power stage (208) comprises a number of $M_N$ Nth level units, and an Nth level unit comprising a number of $M_{N-1}$ (N−1)th level units; and wherein N is an integer greater than or equal to 3, and $M_N$ and $M_{N-1}$ are integers greater than or equal to 1.

20 Claims, 8 Drawing Sheets

(56) References Cited

U.S. PATENT DOCUMENTS

| | | | | |
|---|---|---|---|---|
| 6,548,991 | B1 | 4/2003 | Maksimovic et al. | |
| 6,992,469 | B1 | 1/2006 | King | |
| 7,024,568 | B2 | 4/2006 | Maksimovic et al. | |
| 7,030,567 | B2 | 4/2006 | Ballenger et al. | |
| 7,061,292 | B2 | 6/2006 | Maksimovic et al. | |
| 7,098,641 | B2 | 8/2006 | King | |
| 7,106,040 | B1 | 9/2006 | Maksimovic et al. | |
| 7,109,695 | B2 | 9/2006 | King | |
| 7,211,964 | B2 | 5/2007 | Ballenger et al. | |
| 7,211,992 | B2 | 5/2007 | King | |
| 7,372,382 | B2 | 5/2008 | Hazucha et al. | |
| 7,456,618 | B2 | 11/2008 | Jain | |
| 7,679,345 | B1 | 3/2010 | Verma et al. | |
| 7,714,635 | B2 | 5/2010 | Singh et al. | |
| 7,825,642 | B1 | 11/2010 | Young et al. | |
| 7,919,957 | B2 | 4/2011 | Verma et al. | |
| 8,241,196 | B2 | 8/2012 | Scibona | |
| 8,299,763 | B2 | 10/2012 | Sutardja | |
| 8,689,023 | B2 | 4/2014 | Gupta et al. | |
| 8,812,879 | B2 * | 8/2014 | Wen | G06F 1/26 315/160 |
| 9,020,257 | B2 | 4/2015 | El-Mahdy et al. | |
| 2003/0093160 | A1 | 5/2003 | Maksimovic et al. | |
| 2004/0049703 | A1 | 3/2004 | Maksimovic et al. | |
| 2005/0040800 | A1 | 2/2005 | Sutardja | |
| 2005/0110435 | A1 | 5/2005 | Ballenger et al. | |
| 2005/0146292 | A1 | 7/2005 | Ballenger et al. | |
| 2006/0119336 | A1 | 6/2006 | King | |
| 2006/0119339 | A1 | 6/2006 | King | |
| 2006/0250120 | A1 | 11/2006 | King | |
| 2006/0290547 | A1 | 12/2006 | Hazucha et al. | |
| 2007/0096704 | A1 | 5/2007 | Jain et al. | |
| 2008/0186082 | A1 | 8/2008 | Singh et al. | |
| 2010/0160134 | A1 | 6/2010 | Scibona | |
| 2010/0164445 | A1 | 7/2010 | Verma et al. | |
| 2010/0277141 | A1 | 11/2010 | Sutardja | |
| 2011/0161682 | A1 | 6/2011 | Wen et al. | |
| 2012/0201456 | A1 | 8/2012 | El-Mahdy et al. | |
| 2013/0335043 | A1 | 12/2013 | He et al. | |
| 2014/0002041 | A1 | 1/2014 | Soenen et al. | |
| 2014/0223205 | A1 | 8/2014 | Muthukaruppan et al. | |
| 2014/0266103 | A1 | 9/2014 | Wang et al. | |
| 2014/0277812 | A1 | 9/2014 | Shih et al. | |

FOREIGN PATENT DOCUMENTS

| | | | |
|---|---|---|---|
| WO | WO 1997/044717 | A1 | 11/1997 |
| WO | WO 2004/023278 | A2 | 3/2004 |
| WO | WO 2004/023278 | A3 | 3/2004 |
| WO | WO 2006/062790 | A3 | 7/2010 |
| WO | WO 2010/074929 | A2 | 7/2010 |
| WO | WO 2010/074929 | A3 | 7/2010 |
| WO | WO 2011/042229 | A1 | 4/2011 |
| WO | WO 2014/051545 | A1 | 4/2014 |
| WO | WO 2014/150448 | A2 | 9/2014 |
| WO | WO 2014/150448 | A3 | 9/2014 |
| WO | WO 2015/047276 | A1 | 4/2015 |

OTHER PUBLICATIONS

Chakraborty, et al., "A 1.9nJ/bit, 5Mbps Multi-Standard ISM Band Wireless Transmitter Using Fully Digital PLL," *2013 IEEE Radio Frequency Integrated Circuits Symposium* (*RFIC*), pp. 75-79, 2013.

Chakraborty, et al., "An Ultra Low Power, Reconfigurable, Multi-Standard Transceiver using Fully Digital PLL," *2013 Symposium on VLSI Circuits of Technical Papers,* (*VLSIC*), pp. V148-C149, 2013.

Chen, et al., "Sub-1V Capacitor-Free Low-Power-Consumption LDO with Digital Controlled Loop," *lEEE Asia Pacific Conference on Circuits and Systems* (*APCCAS*), pp. 526-529, 2008.

Chen, et al., "Feedforward simple control technique for on-chip all-digital three phase AC/DC power-MOSFET converter with least components," *IET Circuits, Devices & Systems*, vol. 3, Iss 4, pp. 161-171, 2009.

Chiu, et al., "A 0.6V Resistance-Locked Loop Embedded Digital Low Dropout Regulator in 40nm CMOS with 77% Power Supply Rejection Improvement," 2013 *Symposium on VLSI Circuits Digest of Technical Papers* (*VLSIC*), pp. C166-C167, 2013.

Christen, "A 15-bit 140-μW Scalable-Bandwidth Inverter-Based ΔΣ Modulator for a MEMS Microphone with Digital Output," *IEEE Journal of Solid-State Circuits*, vol. 48, No. 7, pp. 1605-1614, Jul. 2013.

Chan, et al., "Design of a Near-Threshold Digital LDO with Fast Transient Response," *IEEE International SoC Design Conference* (*ISOCC*), pp. 136-137, 2014.

Elshazly, et al., "A 2GHz-to-7.5GHz Quadrature Clock-Generator Using Digital Delay Locked Loops for Multi-Standard I/Os in 14nm CMOS," *2014 IEEE Symposium on VLSI Circuits of Technical Papers* (*VLSIC*), pp. 1-2, 2014.

Gangopadhyay, et al., "Modeling and Analysis of Digital Linear Dropout Regulators with Adaptive Control for High Efficiency Under Wide Dynamic Range Digital Loads," *Design, Automation and Test in Europe Conference and Exhibition*, pp. 1-6, 2014.

Gangopadhyay, et al., "A 32 nm Embedded, Fully-Digital, Phase-Locked Low Dropout Regulator for Fine Grained Power Management in Digital Circuits," *IEEE Journal of Solid-State Circuits*, vol. 49, No. 11, pp. 1-10, Nov. 2014.

Geng, et al., "An 11-Bit 8.6GHz Direct Digital Synthesizer MMIC with 10-bit Segmented Nonlinear DAC," *IEEE European Solid-State Circuits Conference* (*ESSCIRC*), pp. 362-365, 2008.

Guo, et al., "A UHF RFID Reader Transmitter with Digital CMOS Power Amplifier," *IEEE International Symposium on Circuits and Systems* (*ISCAS*), pp. 702-705, 2014.

Guo, et al., "Power-Area-Efficient Transient-Improved Capacitor-Free FVF-LDO with Digital Detecting Technique," *Electronics Letters*, vol. 51, No. 1, pp. 94-95, Jan. 8. 2015.

Hazucha, et al. "A linear Regulator with Fast Digital Control for Biasing Integrated DC-DC Converters," *IEEE International Solid-State Circuits Conference* (*ISSCC*), *Session 29/Power Managemetn and Distribution/29.2*, pp. 1-10, 2006.

Hazucha, et al., "High Voltage Tolerant Linear Regulator with Fast Digital Control for Biasing of Integrated DC-DC Converters," *IEEE Journal of Solid-State Circuits*, vol. 42, No. 1, pp. 66-73, Jan. 2007.

Healey, et al., "Design of a Digital Self-Alignment Controller for a Ship's lnertial Navigation System at Sea," *Proceedings of the Institution of Electrical Engineers*, vol. 122, No. 1, pp. 91-96, Jan. 1975.

Hirairi, et al., "13% Power Reduction in 16b Integer Unit in 40nm CMOS by Adaptive Power Supply Voltage Control with Parity-Based Error Prediction and Detection (PEPD) and Fully Integrated Digital LDO," *IEEE International Solid-State Circuits Conference* (*ISSCC*)/*Session 28/Adaptive & Low_Power Circuits/28.5*, pp. 486-488, 2012.

Hsieh, et al., "All Digital Linear Voltage Regulator for Super-to Near-Threshold Operation," *IEEE Transactions on Very Large Scale Integration* (*VLSI*) *Systems*, vol. 20, No. 6, pp. 989-1001, Jun. 2012.

Huang, et al., "A 2.4GHz ADPLL with Digital-Regulated Supply-Noise-Insensitive and Temperature-Self-Compensated Ring DCO," *International Solid-State Circuits Conference* (*ISSCC*) *Session 15/Digital PLLs/5.3*, pp. 270-272, 2014.

Jiang, et al., "A 2-/3-Phase Fully Integrated Switched-Capacitor DC-DC Converter in Bulk CMOS for Energy-Efficient Digital Circuits with 14% Efficiency Improvement," *2015 IEEE International Solid-State Circuits Conference* (*ISSCC*), pp. 366-368, Feb. 25, 2015.

Jung, et al., "Analog-Digital Switching Mixed Mode Low Ripple-High Efficiency Li-Ion Battery Charger," *IEEE Industry Applications Conference*, pp. 2473-2477, 2001.

Kashani, et al., "Digital Closed Loop design for Wideband Envelope Tracking System," *Convention of Electrical & Electronics Engineers in Israel* (*IEEEI*), pp. 1-6, 2014.

Kaufman, et al., "Digital Adaptive Flight Controller Development," *Conference on Decision and Control including the Symposium on Adaptive Processes*, SAP Paper No. FP5-2, pp. 780-783, 1973.

(56) References Cited

OTHER PUBLICATIONS

Kim et al., "An Ultra-Low Voltage Digitally Controlled Low-Dropout Regulator with Digital Background Calibration," *IEEE 13th International Symposium on Quality Electronic Design* (*ISQED*), pp. 151-158, 2012.
Kok, et al., "A Fully Digital Green LDO Regulator Dedicated for Biomedical Implant Using a Power-Aware Binary Switching Technique," *IEEE Asia Pacific Conference on Circuits and Systems* (*APCCAS*), pp. 5-8, 2012.
Lang, "On the Design of a Special-Purpose Digital Control Processor," *IEEE Transactions on Automatic Control*, vol. AC-29, No. 3, pp. 195-201, Mar. 1984.
Lee, et al., "Comparison of Total dose Responses on High Resolution Analog-to-Digital Converter Technologies," *European Conference on Radiation and Its Effects on Components and Systems* (*RADECS*), pp. 245-250, 1997.
Lee, et al., "Comparison of Total Dose Responses on High Resolution Analog-to-Digital Converter Technologies," *IEEE Transactions on Nuclear Science*, vol. 45, No. 3, pp. 1444-1449, Jun. 1998.
Lee, et al., "A 50nA Quiescent Current Asynchronous Digital-LDO with PLL-Modulated Fast-DVS Power Management in 40nm CMOS for 5.6 times MIPS Performance," *IEEE Symposium on VLSI Circuits Digest of Technical Papers* (*VLSIC*), pp. 178-179, 2012.
Lee, et al., "A single-inductor dual-output converter with switchable digital-or-analog low-dropout regulator for ripple suppression and high efficiency operation," *IEEE Asian Solid State Circuits Conference* (*A-SSCC*), pp. 225-228, Nov. 12-14, 2012.
Lee, et al., "A Low Quiescent Current Asynchronous Digitai-LDO with PLL-Modulated Fast-DVS Power Management in 40nm SoC for MIPS Performance Improvement," *IEEE Journal of Solid-State Circuits*, vol. 48, No. 4, pp. 1018-1030, Apr. 2013.
Lee, et al., "Correction of the Overexposed Region in Digital Color Image," *2014 IEEE International Conference on Consumer Electronics* (*ICCE*), pp. 224-225, 2014.
Lu, et al., "An NMOS-LDO Regulated Switched-Capacitor DC-DC Converter with Fast Response Adaptive Phase Digital Control," *IEEE Transactions on Power Electronics*, pp. 1-10, 2015.
Luo, et al. "Digital Assistant Power Integrated Technologies for PMU in Scaling CMOS Process," *IEEE Transactions on Power Electronics*, vol. 29, No. 7, pp. 3798-3807, Jul. 2014.
Nasir, et al., "Modeling and Analysis of Sysytem in a Distributed Power Delivery Network with Embedded Digital Linear Regulators," *IEEE International Symposium on Quality Electronic Design* (*ISQED*), pp. 68-75, 2014.
Nasir, et al., "A 0.13 μm Fully Digital Low-Dropout Regulator with Adaptive Control and Reduced Dynamic Stability for Ultra-Wide Dynamic Range," *International Solid-State Circuits Conference* (*ISSCC*), *Session 5/Analog Techniques/5.6*, pp. 98-100, 2015.
Oh, et al., "A 110-nm CMOS 0.7-V Input Transient-Enhanced Digital Low-Dropout Regulator with 99.98% Current Efficiency at 80-mA Load," *IEEE Transactions on Very Large Scale Integration* (*VLSI*) *Systems*, pp. 1-6, 2014.
Okuma, et al., "0.5-V Input Digital LDO with 98.7% Current Efficiency and 2.7-μA Quiescent Current in 65nm CMOS," *IEEE Custom Integrated Circuits Conference* (*CICC*), pp. 1-4, 2010.
Onouche, et al., "A 1.39-V input fast-transient-response digital LDO composed of low-voltage MOS transistors in 40-nm CMOS process," in *IEEE Asian Solid State Circuits Conference* (*A-SSCC*), 37-40 (Nov. 2011).
Otsuga, et al., "An On-Chip 250 mA 40 nm CMOS Digital LDO using Dynamic Sampling Clock Frequency Scaling with Offset-Free TDC-Based Voltage Sensor," *IEEE International SOC Conference* (*SOCC*), pp. 11-14, 2012.
Peng, et al., "Real-Time Instruction-Cycle-Based Dynamic Vahage Scaling (iDVS) Power Management for Low-Power Digital Signal Processer (DSP) with 53% Energy Savings," *IEEE Asian Solid State Circuits Conference* (*A-SSCC*), pp. 377-380, Nov. 12-14, 2012.
Peng, et al., "Instruction-Cycle-Based Dynamic Voltage Scaling Power Management for Low-Power Digital Signal Processor with 53% Power Savings," *IEEE Journal of Solid-State Circuits*, vol. 48, No. 11, pp. 2649-2661, Nov. 2013.
Pique, et al., "A 350nA Voltage Regulator for 90nm CMOS Digital Circuits with Reverse-Body-Bias," *IEEE European Solid-State Circuits Conference* (*ESSCIRC*), pp. 379-382, 2011.
Rahnamai, et al., "Fuzzy Logic Regulated Power Supply for a UHF Digital Television Transmission," *IEEE Annual Meeting of the North American Fuzzy Information Processing Society* (*NAFIPS*), pp. 13-18, 2002.
Ramadass et al., "A Fully-Integrated Switched-Capacitor Step-Down DC-DC Converter with Digital Capacitance Modulation in 45 nm CMOS," *IEEE Journal of Solid-State Circuits*, vol. 45, No. 12, pp. 2557-2565, Dec. 2010.
Ramadass, et al., "A 0.16mm2 Completely On-Chip Switched-Capacitor DC-DC Converter Using Digital Capacitance Modulation for LDO Replacement in 45nm CMOS," *IEEE International Solid-State Circuits Conference* (*ISSCC*) *Session 10/DC-PC Power Conversion/10.7*, pp. 208-210, 2010.
Raychowdhury, et al., "A Fully-Digital Phase-Locked Low Dropout Regulator in 32nm CMOS," *2012 Symposium on VLSI Circuits Digest of Technical Papers* (*VLSIC*), pp. 148-149, 2012.
Rikame, et al., "Energy Efficient Solar Based Digital Electronic Weighing Machine," *2014 5th International Conference on Computer and Communication Technology* (*ICCCT*), pp. 355-360, 2014.
Trescases, et al., "A Low-Power DC-DC Converter with Digital Spread Spectrum for Reduced EMI," *Power Electronics Specialists Conference* (*PESC*), pp. 1-7, 2006.
Trinchera, et al., "Quadrature bridge for R-C comparisons Based on Polyphase Digital Synthesis," *IEEE Transactions on Instrumentation and Measurement*, vol. 56., No. 1, pp. 202-206, Jan. 2009.
Wu, et al., "PVT-Aware Digital Controlled Voltage Regulatar Design for Ultra-Low-Power (ULP) DVFS Systems," *IEEE International SOC Conference* (*SOCC*), pp. 136-139, 2014.
Xu, et al. "Digital Adaptive Current Source Driver for Interleaving Boost PFC Converters Under Critical Conduction Mode," *2012 IEEE 7th International Power Electronics and Motion Control Conference* (*IPEMC*), pp. 1049-1053, Jun. 2-5, 2012.
Zhang, et al., "A Digital Adaptive Discontinuous Current Source Driver for High-Frequency Interleaved Boost PFC Converters," *IEEE Transactions on Power Electronics*, vol. 29, No. 3, pp. 1298-1310, Mar. 2014.
Zumek, et al., "Digital Compensator Design for DC-DC Converters Based on FPGA: an educational approach," *IEEE Annual Conference on Industrial Electronics* (*IECON*), pp. 5439-5444, 2006.
State Intellectual Property Office of the P.R.China, International Search Reporting in International Application No. PCT/CN2016/085522 (dated Sep. 14, 2016).

* cited by examiner

THREE-DIMENSIONAL POWER STAGE AND ADAPTIVE PIPELINE CONTROL

CROSS-REFERENCE TO RELATED APPLICATIONS

This patent application is a U.S. National Phase application under 35 U.S.C. § 371 of International Application No. PCT/CN2016/085522, filed on Jun. 13, 2016, which claims the benefit of U.S. Provisional Patent Application No. 62/230,803, filed Jun. 16, 2015, both of which are incorporated herein by reference.

FIELD

The disclosure relates to power stage structure design and control methods for digital linear voltage regulators, and in particular to such regulators which are used to supply digital integrated circuits that have ultra-fast switching activities, for instance, to low drop-out regulators incorporating these structures and techniques.

BACKGROUND

The ever-growing ultra-thin and ultra-light weight portable mobile devices market has driven the great demand for system-on-a-chip (SoC) designs that come along with tens to hundreds of systems or sub-systems being integrated onto a single chip. The scaling of physical dimensions of most recent portable mobile devices has put a bottleneck on the power supply capability provided by the battery. To prolong the lifetime of these portable devices which contain high-performance SoC with high power consumption, the supply voltage of most of the digital integrated circuits (IC) has to scale down to sub-threshold or near-threshold region, especially during standby or idling mode. However, conventional power management techniques implemented mostly in analog circuits cannot provide the required performance, given that analog circuits with scaling supply voltage have to consume more power to maintain performance, such as high gain and high bandwidth.

It has since been a challenge in power management IC (PMIC) design to achieve generation of a fine regulated supply voltage with ultra-fast transient responses that can deliver current ranging from hundreds of milli-amperes to several amperes for digital circuits in the SoC. Digital linear voltage regulators, or sometimes referred to as digital low dropout regulators, is a new category of PMIC that has the potential to fit in these stringent power management requirements of SoC. Digital linear voltage regulators distinguish themselves from their analog counterparts mainly by using a digital controller loop to fully turn-on or turn-off for a portion of or whole units of pass transistors that act as power stages. Conventional digital linear regulator designs can provide functional but non-optimized performance, but these designs suffer from slow transient response or high quiescent current consumption, which are not preferred in PMIC design for a large system such as an SoC.

SUMMARY

An embodiment of the disclosure provides a digital linear voltage regulator including a power stage, arranged in a hierarchical grouping of power stage units. The power stage is configured to deliver power to a load. The digital linear voltage regulator further includes a mixed-signal controller, configured to control each power stage unit in the power stage by conditionally adjust a number of active power stage units in the power stage based on a comparison of a feedback voltage of the load and a reference voltage; wherein the hierarchical grouping of power stage units comprises N levels; wherein the power stage comprises a number $M_N$ of Nth level units, and an Nth level unit comprising a number $M_{N-1}$ of (N−1)th level units; and wherein N is an integer greater than or equal to 3, and $M_N$ and $M_{N-1}$ are integers greater than or equal to 1.

Another embodiment of the disclosure provides an adaptive pipeline controller for a digital linear voltage regulator. The adaptive pipeline controller includes a plurality of ALUs with bi-directional data flow, configured to compare an input signal with a reference signal. The plurality of ALUs include $M_B$ total ALUs with three configurations: (1) the plurality of ALUs are reconfigured into a subset of $M_R$ ALUs in a first configuration with $M_R \leq M_B$; (2) a subset of $M_C$ ALUs in a second configuration with $M_C \leq M_B$; and (3) all $M_B$ ALUs in a third configuration. $M_R$ is a total number of rows, $M_C$ is a total number of columns, and $M_B$ is a total number of bits. A row is made up of one or more columns, and a column is made up of one or more bits. The adaptive pipeline controller further includes $M_R+M_C$ global latches, configured to store ALU results in the first configuration and the second configuration. The adaptive pipeline controller also includes $M_B$ local latches, configured to store ALU results in the third configuration. A controller is included in the adaptive pipeline controller to combine the values of the $M_R+M_C$ global latches with the $M_B$ local latches to drive a power stage in the digital linear voltage regulator.

Yet another embodiment of the disclosure provides a digital linear voltage regulator, with a power stage and a mixed-signal controller. The power stage is arranged in a hierarchical grouping of power stage units and is configured to deliver power to a load. The mixed-signal controller is configured to conditionally adjust a number of active power stage units in the power stage based on a comparison of a feedback voltage of the load and a reference voltage; wherein the hierarchical grouping of power stage units comprises N levels; wherein the power stage comprises a number $M_N$ of Nth level units, and an Nth level unit comprising a number $M_{N-1}$ of (N−1)th level units; and wherein N is an integer greater than or equal to 3, and $M_N$ and $M_{N-1}$ are integers greater than or equal to 1.

BRIEF DESCRIPTION OF THE DRAWINGS

The present invention will be described in even greater detail below based on the exemplary figures. The invention is not limited to the exemplary embodiments. All features described and/or illustrated herein can be used alone or combined in different combinations in embodiments of the invention. The features and advantages of various embodiments of the present invention will become apparent by reading the following detailed description with reference to the attached drawings which illustrate the following.

DETAILED DESCRIPTION

Figure 1:
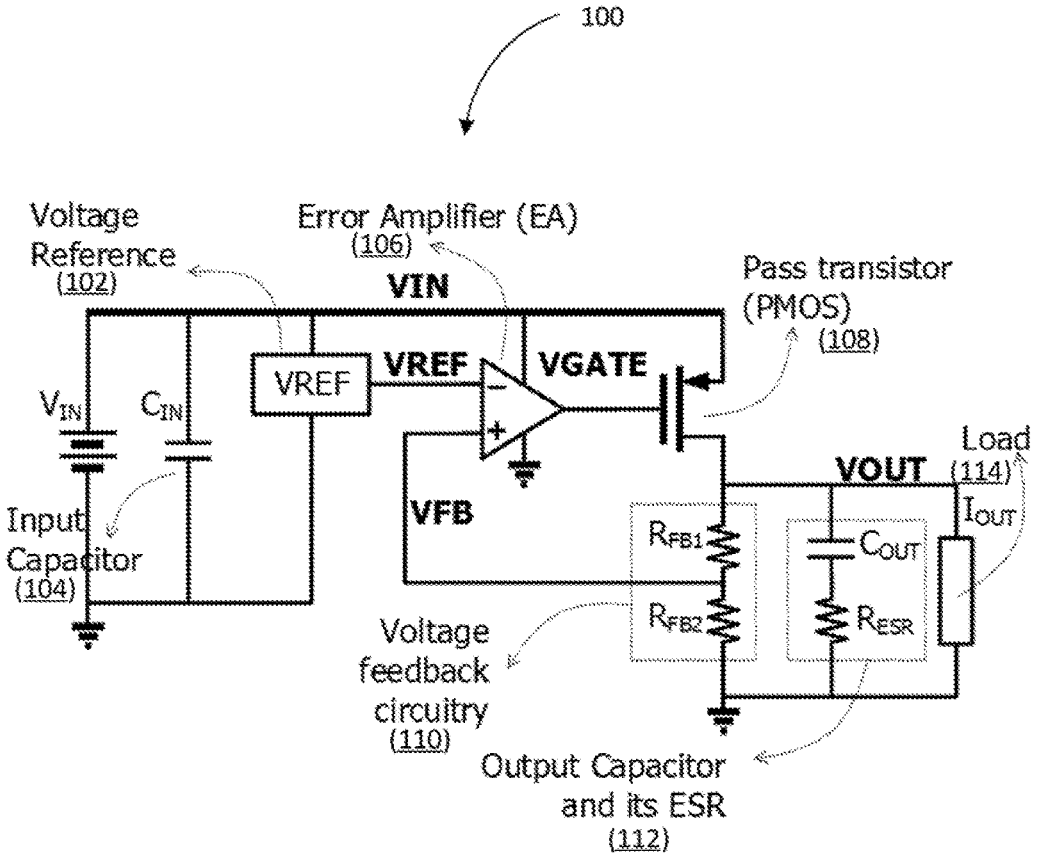
FIG. 1 is an exemplary schematic circuit diagram of a generic linear voltage regulator.

As a result of the shortcomings of conventional digital linear voltage regulators, there is a need in innovations of the design of digital linear voltage regulators tailored for ultra-fast switching digital circuits, in particular in design of the power stage and its controller that target at enhanced speed and resolution performance.

Exemplary embodiments of the invention provide methods, apparatuses, and systems relating to voltage regulation using row-column-bit three-dimensional (3D) power stage with adaptive digital pipeline control. Digital linear voltage regulators utilizing these exemplary embodiments are able to achieve significantly enhanced performance, particularly with respect to speed and resolution, relative to conventional digital linear voltage regulators. The 3D power stage divides and controls power stage units for a speed-resolution balance. Furthermore, a digital adaptive pipeline controller provides for controlling the power stage units via reconfiguring the number of pipeline stages adaptive to in-situ transient speed or resolution requirements. Other exemplary embodiments of the invention may further be applied not just to digital linear regulators, but may also be extended to any devices utilizing switching-mode power supplies to provide a fine-grained power supply with ultra-fast voltage regulation.

Exemplary embodiments of the invention are able to deliver a regulated voltage with fine resolution for supplying fast-switching digital circuits. The pass transistor, or power transistor, of a linear voltage regulator is linearly divided into a large number of small units. Further, in an exemplary embodiment, an adaptive pipeline control is provided to drive the 3D power stage. During operation, turning each bit on or off will only introduce a small error, or ripple, at the regulated voltage, and turning a whole row or column of bits on or off will accelerate the transient response, thus assuring a fine resolution as well as speed. The linear voltage regulator, including the 3D power stage and adaptive pipeline control according to embodiments of the invention, is thus able to deliver output voltage with much finer resolution and recovers faster from ultra-fast transient at loading current and/or reference voltage, compared with conventional digital linear voltage regulators. Accordingly, exemplary embodiments of the invention are applicable in supplying digital integrated circuits with an ultra-fast switching load and/or ultra-fast switching voltage reference, and fits well in the scaling trend of more advanced semi-conductor technologies.

In an exemplary embodiment, the 3D power stage includes three main parts. First, a large number of linearly divided pass transistor units can be configured to be turned on or off individually or together with other units as a group (e.g., forming a column, or a row including multiple columns). Second, a row/column address and data controller, which configure the turn-on and turn-off of the power stage in coarse resolution. And third, a bit controller and driver implemented in close proximity to every power stage unit to help achieve a fine resolution.

In an exemplary embodiment, the adaptive pipeline control used for controlling the 3D power stage also includes three main parts. First, a certain number of arithmetic logic units (ALUs) and the interface circuits between two adjacent ALUs. Second, a group of storage units that are connected to the ALUs. And third, a finite state machine (FSM) that governs reconfiguring the combinations of ALUs and corresponding storage units such that in a closed feedback loop the large number of the 3D power stage units are controlled accordingly.

In an exemplary embodiment, the 3D power stage with the adaptive pipeline control is used in constructing a feedback loop for a digital linear voltage regulator and thus supplying regulated voltage for ultra-fast switching digital circuits.

FIG. 1 illustrates a block diagram for a generic linear voltage regulator 100 having a voltage reference 102, input capacitor 104, error amplifier (EA) 106, P-type power stage or pass transistor 108, voltage feedback circuitry 110, output capacitor and ESR 112, and load 114. The voltage regulator may be connected between a DC supply voltage $V_{IN}$ at node VIN and ground. The voltage regulator receives the DC reference voltage $V_{REF}$ at node VREF generated from voltage reference circuit 102. The function of the voltage regulator is to supply load 114 with a regulated voltage $V_{OUT}$ at node VOUT. The controller of the generic linear voltage regulator 100, which includes EA 106, is configured to generate a correct gate signal $V_{GATE}$ at node GATE, so that in the closed loop $V_{FB}$, a linear portion of output voltage $V_{OUT}$ is set close to reference voltage $V_{REF}$, which enables a large output current $I_{OUT}$ to be delivered to the load 114.

The voltage regulator may utilize a pass transistor 108 of different sizes, and different controllers, largely depending on the requirements of the load 114. Examples of three different types of loads are a constant current load, a resistive load, and a switching load. In some applications, the voltage regulator is used to directly supply these loads as the final stage. In some cases, when the load is a constant current load or a resistive load, the voltage regulator should correct the error at output node VOUT in FIG. 1 when either reference voltage $V_{REF}$ or output current $I_{OUT}$ changes. Thus, a fully analog controller may be used in order to detect the small error between $V_{FB}$ and $V_{REF}$ in FIG. 1.

The fine-grained feature of a voltage regulator using analog controller is unnecessary when supplying switching loads, such as digital circuits. In these instances, a digital controller may suffice to regulate the output voltage $V_{OUT}$. In digital circuits, the correctness of operation will not be jeopardized, as long as the supply voltage provided by voltage regulator is neither much lowered, nor boosted. The safe margin of supply voltage $V_{IN}$, thus determines the worst output voltage precision for the voltage regulator.

Another reason that the digital controller is chosen over its analog counterpart in supplying digital circuits is, when input voltage $V_{IN}$, in FIG. 1, decreases due to scaling in advanced technology, it becomes difficult for analog controllers to achieve a high gain or a fine precision compared to a large $V_{IN}$ in the less advanced technology.

Additionally, in practice, digital circuits, as the load of voltage regulators, may be much more complicated, resulting in unpredictable switching of output current $I_{OUT}$. In order to supply a regulated voltage for switching loads such as digital circuits, the voltage regulator using a digital controller should be capable of switching ON/OFF a large number of piecewise pass transistors to cater to a wide range of possible output current $I_{OUT}$ changes.

The application of digital linear voltage regulators, especially to near-threshold logic circuits, has become popular. Conventional digital linear voltage regulators are usually comprised of a linearly or non-linearly divided pass transistor and its controller, which can be identified in two categories. The first controller category usually contains a comparator that is driven by, for example, a shift-register, which needs a global clock, or a bidirectional pipeline, which may be clocked locally to save power. For such digital controllers, the comparator is usually required to achieve very fast speed in each comparison. The design limitations to the comparator may result in sacrificing the resolution due to the high dependence on number of bits in digitally representing the analog signal. The second controller category for digital linear voltage regulator uses phase locked loops (PLLs), or other semi-analog semi-digital techniques to generate a fine-grained output voltage. However, the speed may not be comparable to the controllers using single-stage comparators for analog to digital (A/D) conversion.

Relative to these conventional technologies, embodiments of the invention provide innovations both in the power stage design and the controller, so as to achieve better achieve a speed-resolution balance.

Figure 2:
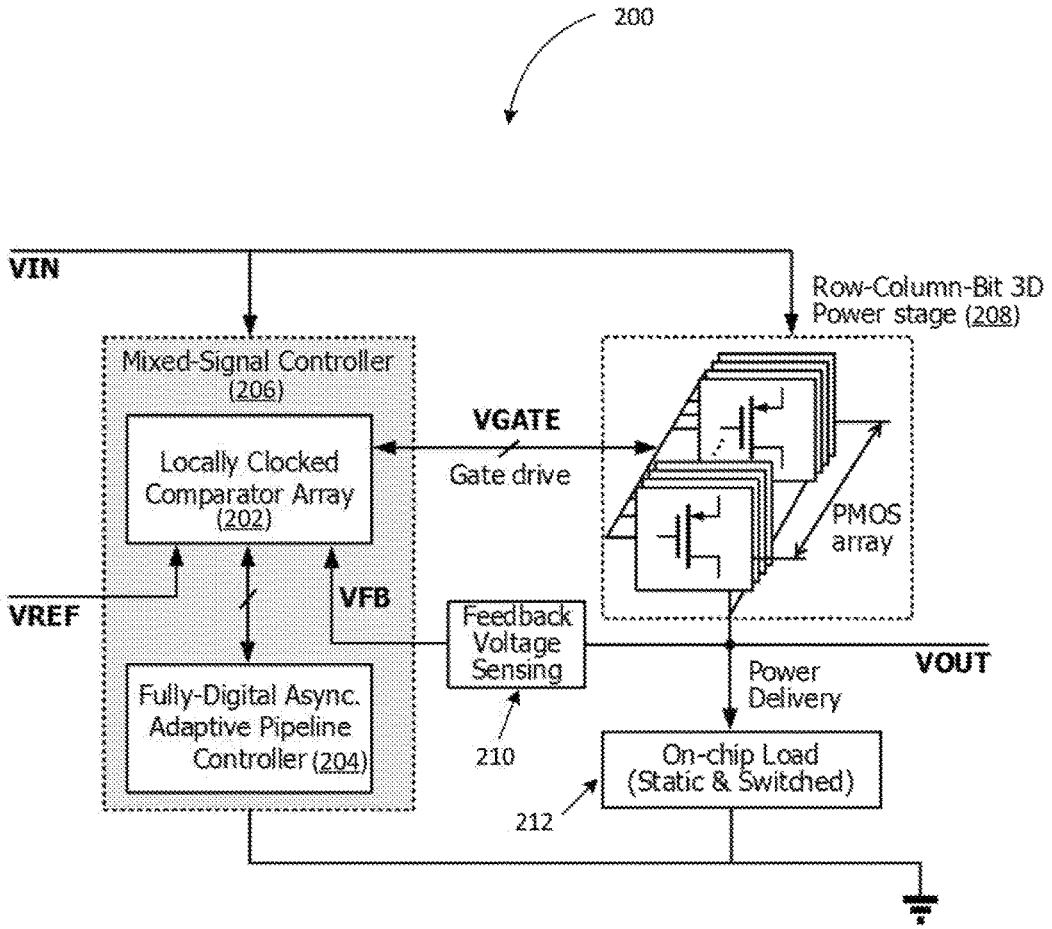
FIG. 2 is a schematic circuit diagram illustrating the structure of a digital linear voltage regulator in an exemplary embodiment.

FIG. 2 illustrates a schematic circuit diagram of a digital linear voltage regulator 200 in an exemplary embodiment of the invention. It shows how piecewise pass transistors, referred to as power stage units 208 hereafter, are driven by mixed-signal controller 206. The mixed-signal controller 206 includes a locally clocked comparator array 202 and a fully-digital asynchronous adaptive pipeline controller 204. Similar to a voltage regulator with an analog controller, the generated output voltage, at node VOUT, is regulated within the precision requirement of load 212, which may be a digital circuit. In contrast to a voltage regulator with an analog controller, the voltage regulator explicitly defines the resolution, N-bit, of output voltage $V_{OUT}$, from the number M of power stage units (e.g. $2^N$=M for M linearly divided power stage units).

However, as the increment of M and N generates a better resolution, the voltage regulator may consume much more power to achieve an equally fast response to any changes at the loading current and reference voltage, assuming the same control methodology is adapted in switching ON/OFF more power stage units as M and N increase. This extra power consumption may degrade the efficiency of the said voltage regulator 200, thus preventing the generation of a high resolution while maintaining high speed.

Figure 3:
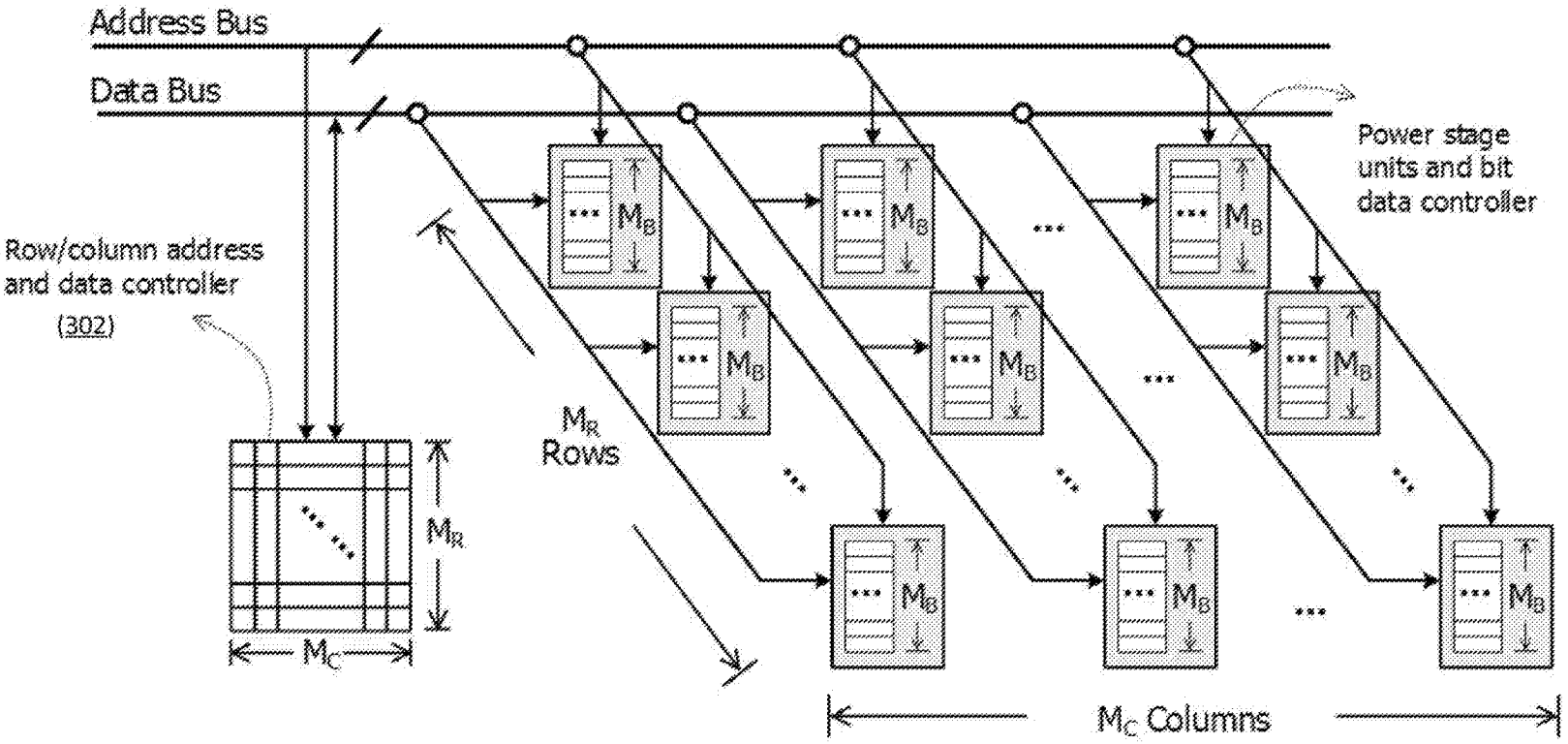
FIG. 3 illustrates a detailed view of a power stage in an exemplary embodiment, with the row/column address and data controller connecting to the address/data bus and bit data controller embedded with the power stage unit.

FIG. 3 illustrates a detailed view of the power stage 208, with row/column address and data controller connecting to the address/data bus and bit data controller embedded with the power stage unit 208, according to some embodiments of the disclosure. By using a row-column-bit three-dimensional (3D) power stage 208 and an adaptive pipeline controller 204, exemplary embodiments achieve multiple resolutions to fulfill speed-resolution balance requirements, in steady operation or during transient response. In an exemplary embodiment, the 3D power stage 208 is linearly divided into $M_R$ rows, and each row is linearly divided into $M_C$ columns, where each column is further linearly divided into $M_B$ bits, as illustrated in FIG. 3.

For regulating the output voltage, the correct number of power stage units, in particular the correct number of $M_R$ rows, $M_C$ columns, and $M_B$ bits shall be turned on/off. For the 3D power stage embodiment as illustrated in FIG. 3, a power-efficient method to control such a large number of units is provided. The mixed-signal controller 206 in FIG. 2 makes a decision, and the decision is stored on the address bus and data bus as illustrated in FIG. 3. The row/column address and data controller 302 represents a circuit block that provides data for each column of power stage units via the data bus, according to the signal from the address bus. The power stage units in FIG. 3, in group of columns, also receive the signal from address bus, and decide whether to use the row/column data or the bit data. During bit operation, only one column is being controlled, while the other columns maintain their previously latched data from the row/column address and data controller 302, via the data bus. Therefore, in some embodiments of the invention, the 3D power stage is able to access and update the data in its minimum unit, i.e., the bit unit, via the address bus and data bus. The maintenance of the address and data buses is performed by other circuit blocks, discussed in the following descriptions.

The terms "row", "column" or "bit" are used mainly for a clearer demonstration of the topology relationship while not referring to the physical placement. More generally, a hierarchical grouping of N levels is described, where the power stage is made up of a number $M_N$ of Nth level units, and an Nth level unit is made up of a number $M_{N-1}$ of (N−1)th level units. N here is an integer greater than or equal to 3, and $M_N$ and $M_{N-1}$ are integers greater than or equal to 1 It will be appreciated that the "linear" division of "row", "column" or "bit" (i.e., where N=3 with bit being the lowest level, column being an intermediate level, and row being a highest level) is not required, and other exemplary embodiments may use other, more complicated manners of division.

For example, the linear division of power stage units may be suitable for a wide range of applications in which the output voltage of the power stage needs to be regulated at a wide output current range as stable as possible. Such applications usually require such a design that a linearly-sized output current change can be realized by turning on a linearly-sized power stage unit. Some other exemplary applications may focus on the regulated output voltage tracking a wide range of reference voltage at a certain output current. Therefore, in such other applications, the power stage unit size may not be linear, and may instead be determined with respect to the specified output voltage and current levels.

The 3D power stage illustrated in FIG. 3 is a detailed view of the power stage 208 as shown in FIG. 2. In FIG. 3, the address bus and data bus provide a convenient and fast access to all $M_R$ rows, $M_C$ columns and $M_B$ bits, meanwhile generating a fine resolution N-bit which can be expressed by: $2^N=M_R \times M_C \times M_B=M_{Total}$. In addition to achieving the same high resolution compared with a conventional power stage that is directly divided into a large number $M_{Total}$ of units and controlling each of them in a gradual access, the said 3D power stage allows a number of access combinations of rows, columns or bits. This extra freedom of accessing different numbers of bits at a time, referred to as 3D access of power stage units herein, provides for improvement of voltage regulation speed without loss of resolution. For example, in a conventional approach, if $M_{Total}=1000$ and all power stage units are currently OFF, in order to turn them all ON which is the worst-case scenario, it would take 1000 steps to turn on each power stage unit individually. A decision is made to turn ON power stage unit 1, then power stage unit 2, then power stage unit 3, and all the way till power stage unit 1000. When using an embodiment of the invention and selecting $M_R=10$, $M_C=10$, and $M_B=10$ in the same scenario, to turn ON all 1000 power stage units, only 10 steps would be needed to turn ON rows 1 to 10.

While in a worst-case scenario, which needs 999 (1000–1) units to be turned ON, 10 steps would be needed to search through rows 1 to 10 to turn ON 9 rows, 10 steps would be needed to search through columns 1 to 10 to turn ON 9 columns, and 10 steps will be needed to search through bits 1 to 10 to turn on 9 bits. Thus, only 30 steps, instead of 999 steps in a conventional approach, are needed to turn on the correct number of power stage units in this worst-case scenario. In this example, it is assumed that the number of decision steps to turn on n units at a certain dimension is only n+1, in which the extra one step is needed to correct the last unit before switching dimensions, e.g., from row-wise to column-wise control in the aforementioned embodiment of the invention.

Figure 4A:
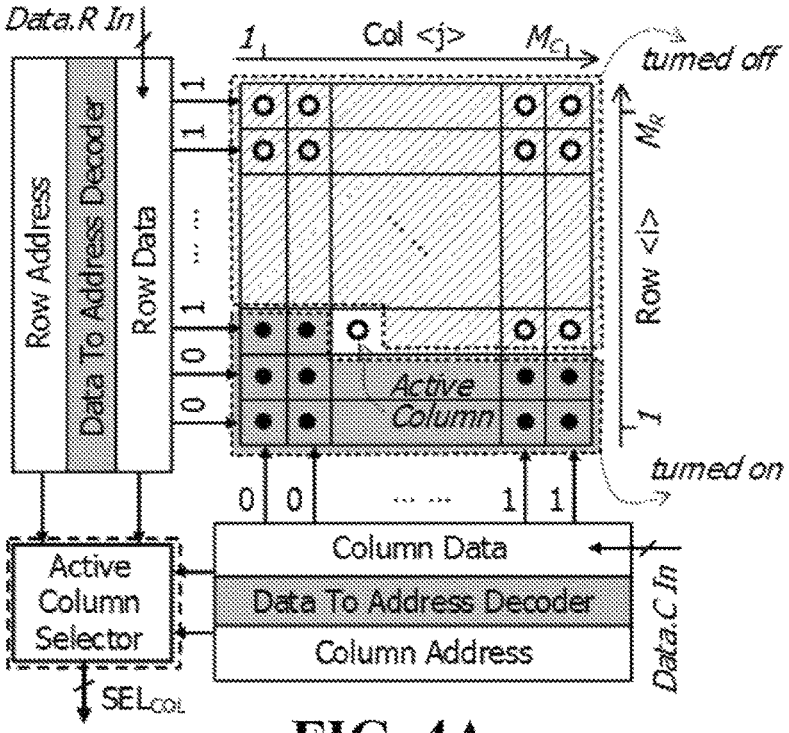
FIG. 4A shows a more detailed view of the row/column address and data controller of FIG. 3, with an equivalent row/column data memory map.

FIG. 4A illustrates a functional block in an exemplary embodiment which enables 3D access of power stage units. It is a more detailed view of subset row/column address and data controller 302 in FIG. 33. This block includes two parts: the first part is a row/column data and address decoder which determines the access of each bit either directly or by combination in group of row or column. The second part is an equivalent number $M_R \times M_C$ array of latches that store the digital code "0" or "1" which maps the turn ON or turn OFF of each power stage unit's bits in group of column. These digital codes can be passed, via data bus in FIG. 33, to addressed columns of power stage units, achieving a coarse resolution of regulation at the beginning of voltage regulation. FIG. 4A contains both row and column control operations of the mixed-signal controller 206; and in some embodiments, the row control is performed before the column control. For example, to obtain the state in FIG. 4A, row control turns ON the entire bottom two rows (Row<1> and Row<2>), and since the entire third row (Row<3>) does not need to be turned ON, column control is performed. During column control, the first column of the third row (Row<3>, Col<1>) is switched ON, then the second column of the third row (Row<3>, Col<2>) is turned ON, and then the controller determines that the entire third column of the third row (Row<3>, Col<3>) does not need to be turned ON so it designates this column as an active column. The previous discussion shows that when referring to a "group of row", each horizontal row is controlled as a group, during row operation. When referring to a "group of column", each vertical column in one row is controlled as a group, during column operation. As presented, row control operations allow control of a large number of units at a time, column control operations allow for control of a smaller number of units at a time.

Figure 4B:
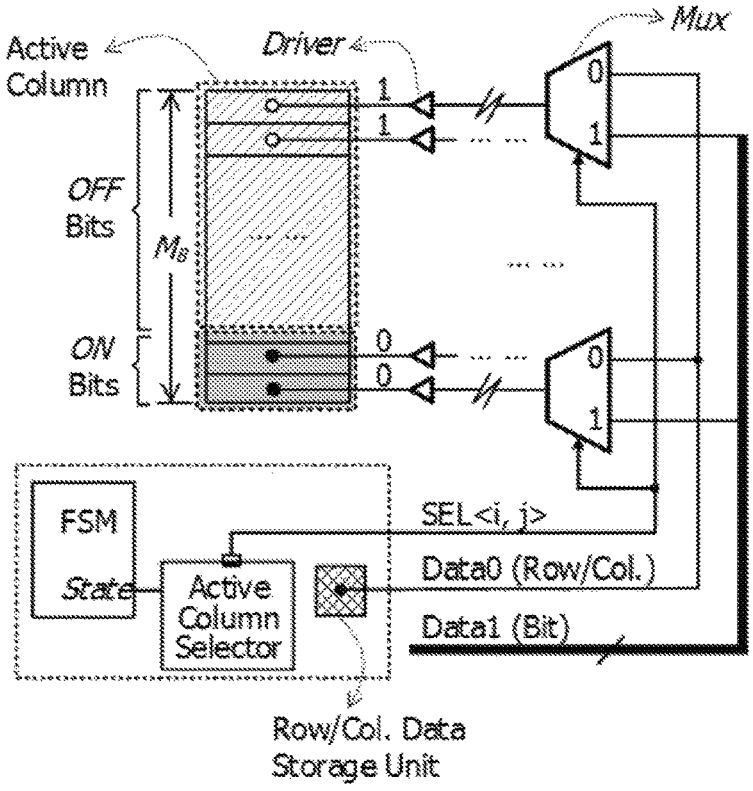
FIG. 4B shows a more detailed view of the bit data controller of FIG. 3, illustrating a multiplexer connecting to a driver which directly controls a single power stage unit.

Following FIG. 4A, another functional block, that realizes a fine resolution within the coarsely bounded vicinity of the target regulated voltage, is illustrated in FIG. 4B. Referring to FIG. 4A, the row/column address decoder may select one column at the border of the turned-ON and turned-OFF column-grouped power stage units. Here the term "border" does not refer to physical location of these power stages. The bits inside the selected column in FIG. 4A, referred to as active column hereafter, will not be controlled by the said digital code "0" or "1" that is passed on the global data bus Data0, but can be controlled bit-wise via the local data bus Data1 within the block in FIG. 4B. SEL<i,j> is a binary value (in this case a single bit) that determines whether to use the already stored value on the global data bus Data0 or a locally determined value on the local data bus Data1.

The said bit-wise control as illustrated in FIG. 4B, is similar to the aforementioned row- or column-wise control, in terms of the process of determining the number of units to be turned ON or OFF. Once row control and column control operations are performed, an active column is selected for the bit-wise control. One major difference among the bit-, column- and row-wise control, is the number of minimum sized units to be controlled per step change. In particular, the bit-wise control is usually gradual as each step change is relatively small; while the column- or row-wise control is more abrupt.

The functional blocks illustrated in FIG. 4A and FIG. 4B, when used to implement an embodiment of the 3D power stage, may provide a fast speed in access and switching ON/OFF of power stage units. These functional blocks may also result in providing a finer resolution compared with the conventional techniques that do not contain the bit-wise control such as shown in FIG. 4B.

Another aspect of exemplary embodiments of the invention includes adaptive digital pipeline controller 204. The term "adaptive" mainly refers to the ability of being reconfigured into different numbers of cascaded pipeline units to provide digital control of the 3D power stage according to various requirements. The reconfiguration of pipeline units is mainly categorized in two modes, shown in FIGS. 5A and 5B respectively. In other exemplary embodiment, a non-adaptive pipeline controller may be used.

Figure 5A:
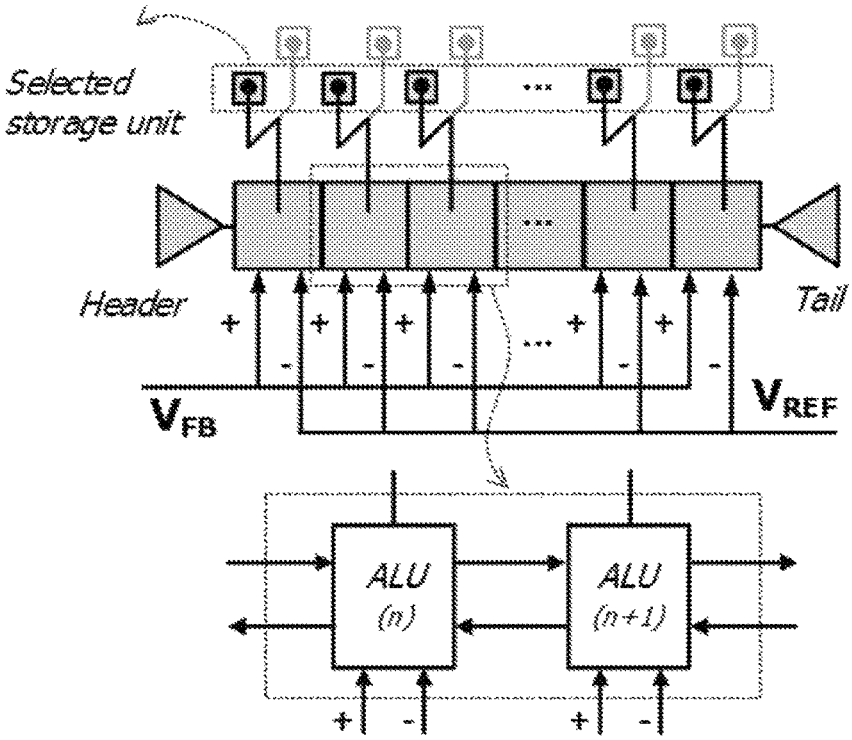
FIG. 5A illustrates a pipeline controller in a first operation mode, with bi-directionally connected arithmetic logic units and selected storage units.

FIG. 5A illustrates the pipeline controller in a first operation mode according to an exemplary embodiment. Referring to FIG. 5A, when a pipeline controller is configured with a certain number of cascaded arithmetic logic units (ALUs), a bi-directional data flow will be constructed. The bi-directional data flow is facilitated by a global or local clock, enabling the successive comparison of received analog signals to generate the digital code by which data in the selected storage units are refreshed. The storage units are selected based on the in-situ operation mode. Thus for the bit-wise control, the data will be written on the data bus Data1 in FIG. 4B, instead of overwriting the data written on the data bus Data0 during row- and column-wise control. The header and tail in FIG. 5A and FIG. 5B set the boundary for the said bi-directional data flow. A simplified design for the header or tail may be achieved by reusing an ALU while forcing the clocked data to reverse the propagation once it arrives.

Figure 5B:
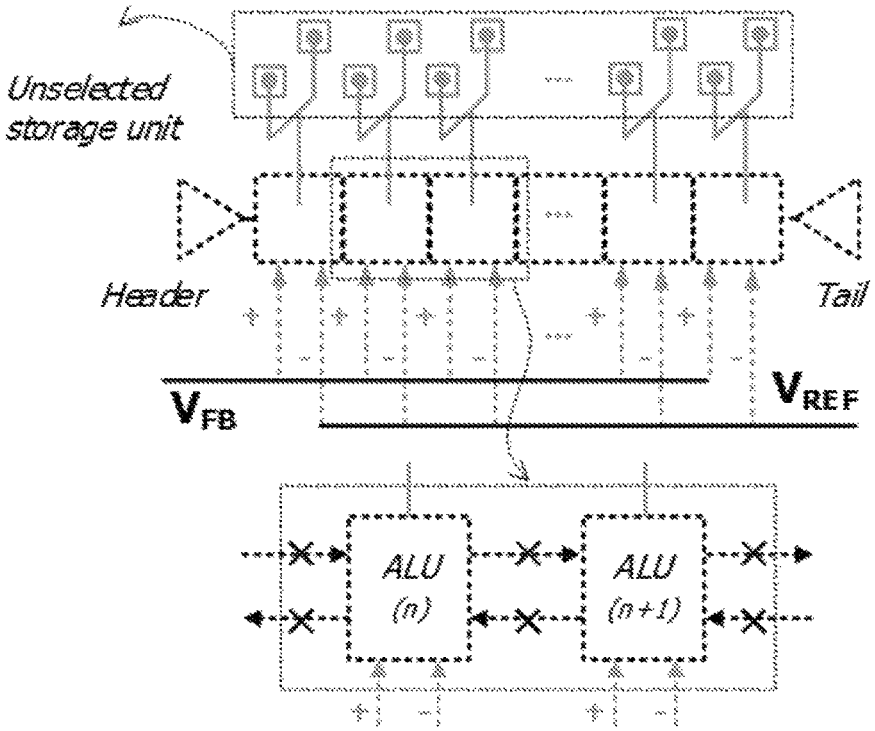
FIG. 5B illustrates the pipeline controller in an idle or standby mode, with the arithmetic logic unit connections being cut off and unselected storage units.

FIG. 5B illustrates the pipeline controller in a second operation mode according to an exemplary embodiment. In the second mode, referring to FIG. 5B, for the remaining parts of the pipeline controller units, the data flow between any adjacent ALUs are cut off, and no further comparison of coupled analog signals will be performed. Thus, an unselected storage unit will remain with its original digital code.

Figure 6:
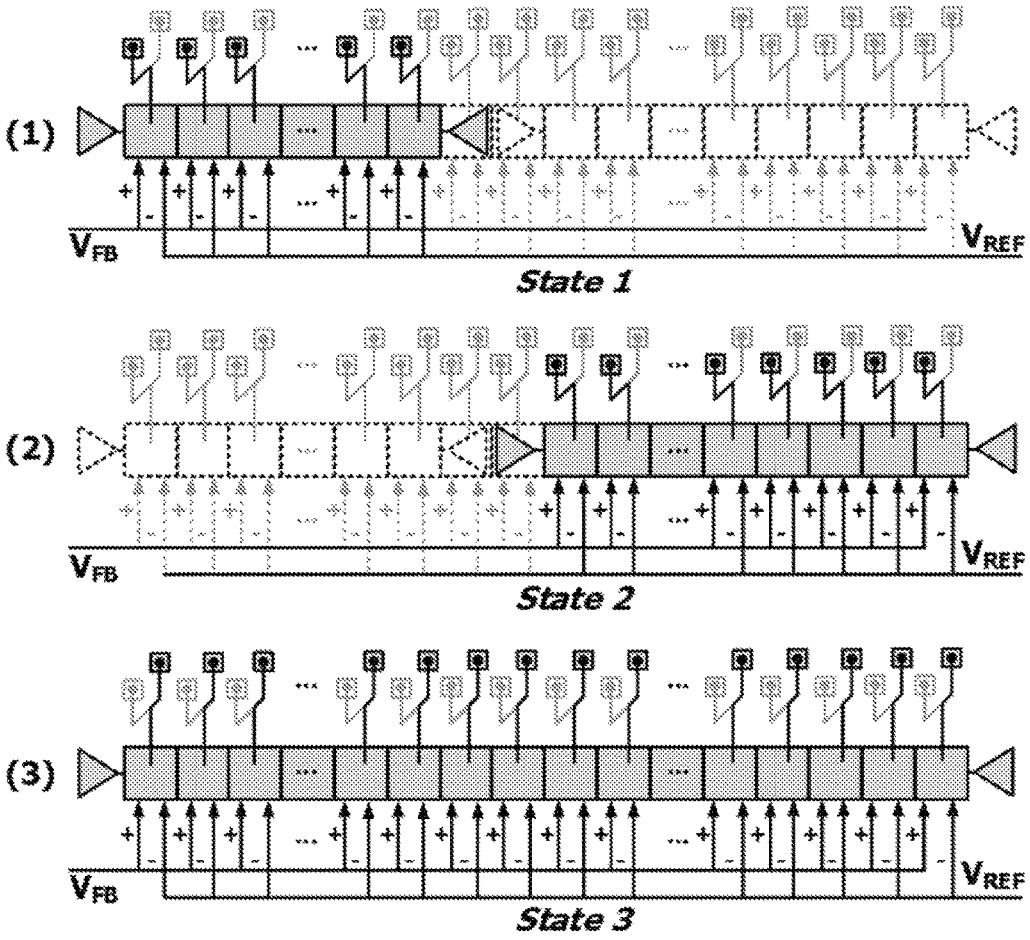
FIG. 6 shows the operation of adaptive pipeline controller in an exemplary embodiment, including three states in particular, and connections to analog signal inputs and digital storage units.

FIG. 6 shows the operation of an adaptive pipeline controller in three states according to an exemplary embodiment. As illustrated in FIG. 6, based on the two reconfiguration modes of FIGS. 5A-5B, an exemplary method of controlling the 3D power stage is used in implementation of the adaptive digital pipeline controller. To achieve better area efficiency, in some embodiments, a total number of $2\times M_B$ storage units (e.g. latches) are used to account for access and control of $M_{Total}$ power stage unit bits, assuming that $M_B$ is at least one larger than the sum of $M_R$ and $M_C$. This design criterion is determined to promote the use of as few storage units as possible since each storage unit consumes on-chip area. When using this criterion, $M_B$ storage units are used to store $M_B$-bit long results from bit-wise control, and the other $M_B$ storage units are divided into two parts: $M_R$ storage units for rows and $M_C$ storage units for columns. Using this type of division, $M_R+M_C+M_B$ storage units are used to cover the data requirements for the entire $M_R\times M_C\times M_B$ power stage units.

Referring to FIG. 6, the operation of the adaptive digital pipeline controller, which drives the equivalently large number $M_{Total}$ of power stage unit bits, can be demonstrated in three steps. In order to regulate the output voltage $V_{OUT}$ as in FIG. 2, the coarse digital code (e.g. equivalent to $M_R$ rows and $M_C$ columns) is first generated. The digital code is used for turning ON/OFF power stage units in a group of rows and a group of columns, represented by State 1 and State 2, respectively. After which, the fine digital bit code (e.g. equivalent to $M_B$ bits inside the said active column) is further generated in State 3. The generation of the said row/column or bit code is from comparison of $V_{REF}$ and $V_{FB}$. In other words, the in-situ regulation of output voltage is achieved by performing comparisons and turning bits ON/OFF in different combinations. Since the pipeline serves as a bidirectional data flow generator, the linear regulator determines whether to turn ON the next unit, or turn OFF a previously turned ON unit. The previously generated "0" or "1" needs to be stored along the pipeline, in order to make the determination. Therefore, not only does the pipeline in FIG. 6 State 3 require storage units, but the pipelines in State 1 and State 2 both require storage units. For example, the pipeline shown at State 1 of FIG. 6 provides row operation or row-wise control of $M_R$ groupings, with each grouping having a size equal to $M_C\times M_B$ storage units. The pipeline shown as State 2 of FIG. 6 provides column operation or column-wise control of $M_C$ groupings, with each grouping having a size equal to $M_B$ units. The pipeline shown as State 3 of FIG. 6 provides bit operation or bit-wise control of $M_B$ groupings, with each grouping having a size equal to 1 storage unit. This is why $M_R+M_C+M_B$ storage units are used to cover effectively a $M_R\times M_C\times M_B$ storage requirement.

It should be noted that, after being reconfigured based on the current state, the pipeline shall start the data flow in a similar way. Generally, for a more feasible implementation of reusable pipeline structures, the said data flow under each state distinguishes themselves mainly by two factors: first, the length of connected, or active pipeline ALUs; and second, which storage units will be used for storing the data used to control the power stage units. In some embodiments, as shown in FIG. 6, the pipeline for State 1 (row) and State 2 (column) may be reused, and the pipeline unit (ALU) may be reused as a header/tail to realize a bi-directional data flow, as explained in FIGS. 5A-B. In some cases, for ease of implementation, at least 1 unit gap may be left between the row-pipeline and column-pipeline.

Figure 7B:
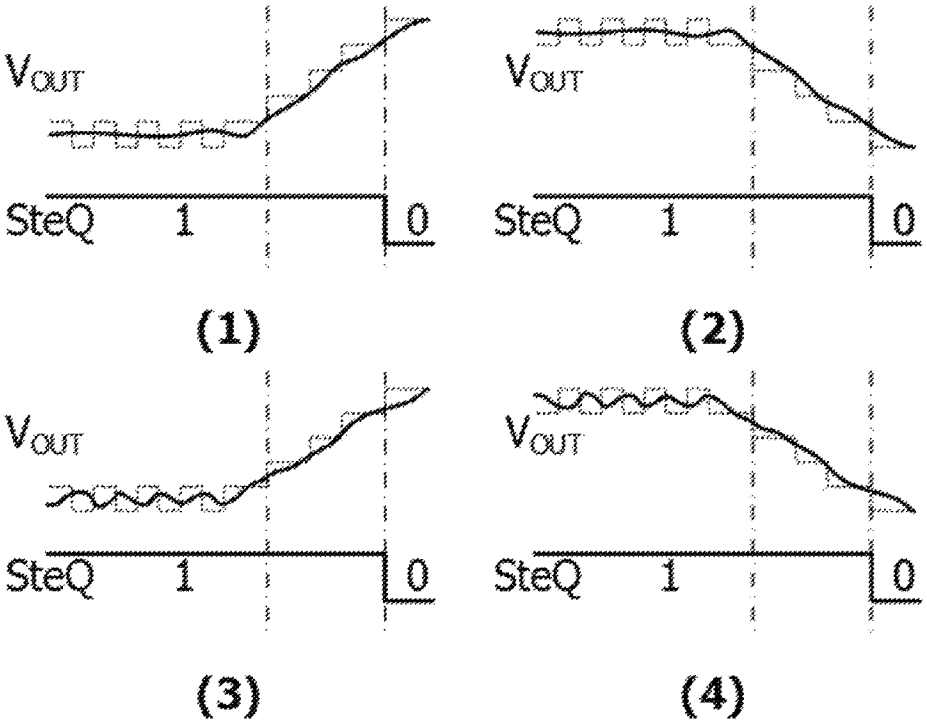
FIG. 7B is a group of waveforms illustrating how the control flag signal SteQ in the finite state machine of FIG. 7A is generated in different scenarios.
Figure 7A:
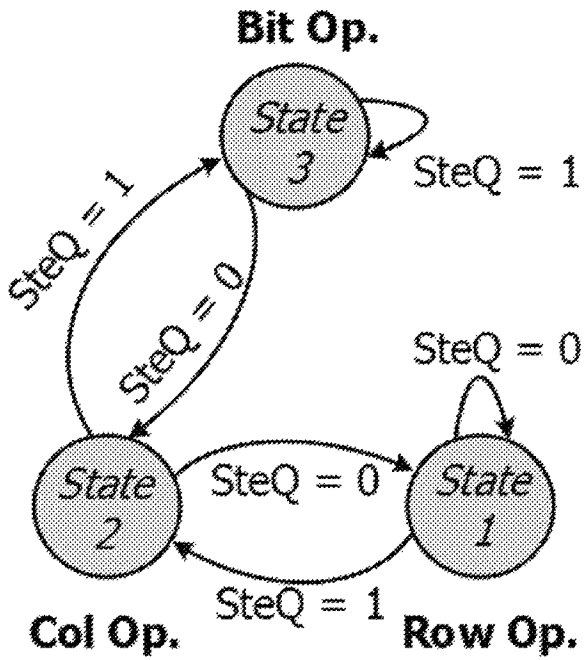
FIG. 7A is the diagram illustrating the working of a finite state machined that governs an adaptive digital pipeline controller by generating proper states.

The digital pipeline controller, as shown in FIG. 6, is governed by a finite state machine (FSM). As illustrated in FIG. 7A, the FSM provides for appropriate reconfiguration of the pipeline structure, as shown in State 1, State 2, and State 3 of FIG. 6. Three pre-defined states "State 1", "State 2" and "State 3" refer to access and control operation on row, column and bit, respectively.

The decision of the FSM's transition from a current state to a next state is dependent on how the digital code steady signal SteQ changes its value. FIG. 7B illustrates the generation of signal SteQ in four simplified general scenarios. For example, in graphs (1) or (2) of FIG. 7B, during a normal bit operation when the output voltage is finely regulated and no large variation of digital code is detected, SteQ remains "1" (true), and the digital controller, as in step (3) of FIG. 6, may continuously operate in bit-wise control. However, if for a time a certain number of digital codes are detected to have changed, SteQ is issued "0" (false), and the change of SteQ may drive the FSM to change its current state from "State 3" (bit-operation) to "State 2" (column-operation). It should be noted that the border of increasing or decreasing the number of turn-ON or turn-OFF bits varies for "State" 1 to 3, such that the signal SteQ still remains "1" in graphs (3) or (4) of FIG. 7B, as the ripple does not exceed the tolerance of one-bit change at column or row operation. Detection of change in SteQ signal may be achieved using digital logic.

As a result, the 3D power stage and the adaptive digital pipeline controller may both be coordinated by the FSM, which in combination may bring forth performance improvements in the application of the digital voltage regulator, especially enabling a balance in high speed response and high resolution of output voltage.

Figure 8A:
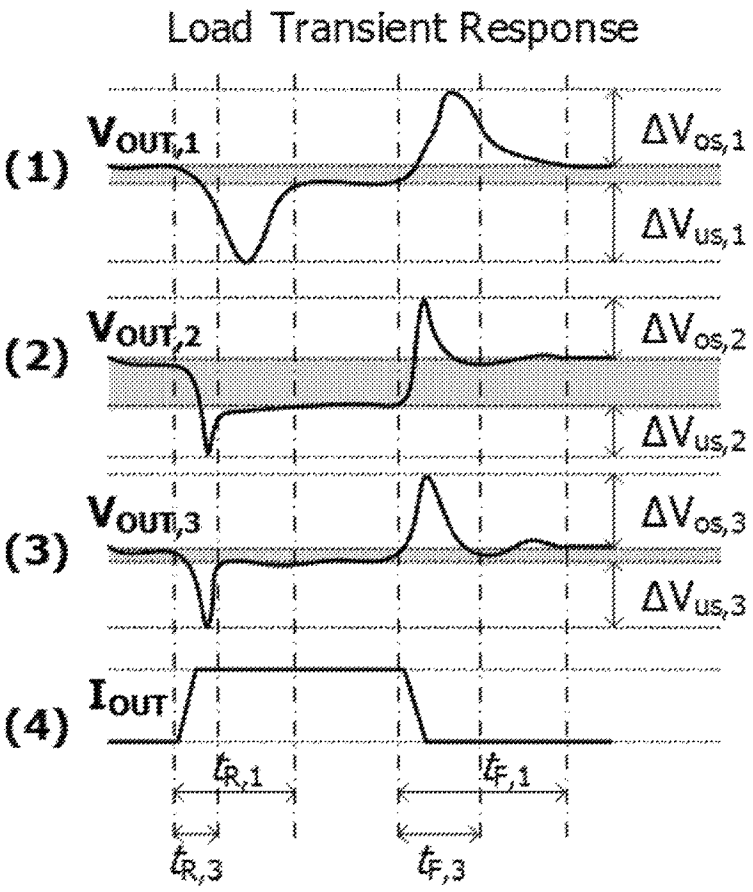
FIG. 8A shows a comparison of performance in load transient response, in particular, between an exemplary linear voltage regulator according to an exemplary embodiment of the invention versus conventional linear voltage regulators (the comparison illustrates the output voltage waveforms as well as the output current transient waveform)
Figure 8B:
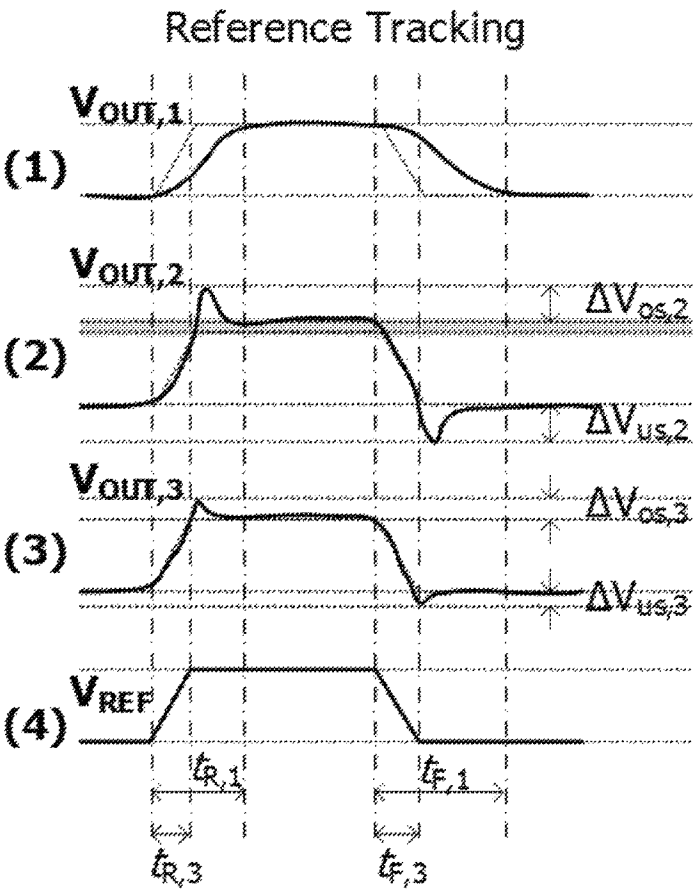
FIG. 8B shows a comparison of performance in reference, in particular, between an exemplary linear voltage regulator according to an exemplary embodiment of the invention, versus conventional linear voltage regulators (the comparison illustrates the output voltage waveforms as well as the reference voltage transient waveform).

FIGS. 8A-8B illustrate comparisons for load transient response and reference tracking, respectively. In particular, a digital linear voltage regulator in an exemplary embodiment is compared with conventional digital linear voltage regulators which use a one-dimensional power stage.

Referring to the output voltage waveforms for the comparison of load transient response, illustrated in FIG. 8A, three output voltages are shown as graphs (1)~(3) representing three digital linear regulators that are assumed to have the same maximum $I_{OUT}$ capability. With the same total power stage sizing, graphs (1) and (2) represent the conventional digital linear regulator when the power stage is linearly divided into $M_1$ and $M_2$ units respectively, with the condition that $M_1$ is much larger than $M_2$. Graph (3) represents an output voltage $V_{OUT}$ of a digital linear regulator that adopts adaptive techniques according to an embodiment of the invention, in which the power stage is divided into $M_2$ large units and each large unit is further divided into $M_1$ small units. Graph (4) represents a fast transient in the output current $I_{OUT}$, including a rising edge and falling edge.

From FIG. 8A, the output voltage $V_{OUT,1}$, as shown in waveform (1), has a fine resolution, implying a smaller variation for each bit change. However, the response speed is very slow because more bits need to be turned ON/OFF in a sequential order. In waveform (2), $V_{OUT,2}$ achieves a fast speed response but is lacking resolution, which may cause incorrect digital operations. The undershoot and overshoot voltages of waveforms (1) and (2) are comparable due to the fact that the dynamic voltage shooting has a stronger dependence on current change range during load transient. The waveform (3), illustrating the output voltage $V_{OUT,3}$ generated by an exemplary implementation of the invention, achieves improvements in performance—i.e., high response speed during load transient and high resolution to provide a well-regulated supply voltage.

Similarly, from FIG. 8B, the performance comparison of reference tracking is given by waveforms (1)~(3) and the reference voltage $V_{REF}$ waveform. As can be seen in FIG. 8B, the exemplary implementation of the invention (corresponding to waveform (3)), achieves improved reference voltage tracking speed and reduced overshoot and undershoot due to the adaptive resolution. Furthermore, the exemplary implementation of the invention is able to settle down to a fine regulated voltage, which is assured by the equivalent large number of bits that can be turned ON or OFF in voltage regulation in accordance with the 3D power stage and its adaptive pipeline control.

An exemplary voltage regulator built according to some embodiments of the invention in 65 nm low-leakage CMOS technology is able to operate between 0.6V and 1V and provide a maximum current of 500 mA to a capacitive load of 1.5 nF. The 65 nm regulator is shown to exhibit the best figures of merit compared to other regulators in literature.

An embodiment of the disclosure provides a technique for dividing and controlling power stage units for a speed-resolution balance. In this structure, power stage units are divided into a large number of small units such that the last bit error is significantly reduced for a fine resolution. The flexibility of simultaneously controlling one or more power stage units targeting an ultra-fast transient response is enabled by this technique.

Another embodiment of the disclosure provides a technique for controlling power stage units by reconfiguring a number of pipeline stages adaptive to in-situ transient speed or resolution requirements. A pipeline controller utilizing this technique may be reconfigured with different number of pipeline stages to digitally control a group of, or individual power stage units according to in-situ transient conditions. Additional criteria for the pipeline controller to realize area and power efficiency is also provided.

Yet another embodiment of the disclosure provides a digital linear voltage regulator including a power stage, arranged in a hierarchical grouping of power stage units. The power stage is configured to deliver power to a load. The digital linear voltage regulator further includes a mixed-signal controller, configured to control each power stage unit in the power stage by conditionally adjust a number of active power stage units in the power stage based on a comparison of a feedback voltage of the load and a reference voltage; wherein the hierarchical grouping of power stage units comprises N levels; wherein the power stage comprises a number of $M_N$ Nth level units, and an Nth level unit comprising a number of $M_{N-1}$ (N−1)th level units; and wherein N is an integer greater than or equal to 3, and $M_N$ and $M_{N-1}$ are integers greater than or equal to 1.

Embodiments of the disclosure further provide a digital linear voltage regulator, wherein the mixed-signal controller conditionally adjusts the number of active power stage units in the power stage by performing the steps of: (1) determining whether each row in the $M_R$ rows should be activated or deactivated, and conditionally activating and deactivating each row accordingly, wherein all power stage units in an activated row deliver power to the load; (2) selecting a single row in the $M_R$ rows and determining whether each column in the single row should be activated or deactivated, and conditionally activating and deactivating each column accordingly, wherein all power stage units in an activated column deliver power to the load; and (3) selecting a single column in the single row and determining whether each bit in the single column should be activated or deactivated, and conditionally activating and deactivating each bit accordingly, wherein all power stage units in an activated bit deliver power to the load; and wherein all power stage units in activated rows, activated columns, and activated bits are active power stage units.

Embodiments of the disclosure further provide an adaptive pipeline controller for a digital linear voltage regulator. The adaptive pipeline controller includes a plurality of ALUs with bi-directional data flow, configured to compare an input signal with a reference signal. The plurality of ALUs include $M_B$ total ALUs with three configurations: (1) the plurality of ALUs are reconfigured into a subset of $M_R$ ALUs in a first configuration with $M_R \leq M_B$; (2) a subset of $M_C$ ALUs in a second configuration with $M_C \leq M_B$; and (3) all $M_B$ ALUs in a third configuration. $M_R$ is a total number of rows, $M_C$ is a total number of columns, and $M_B$ is a total number of bits. A row is made up of one or more columns, and a column is made up of one or more bits. The adaptive pipeline controller further includes $M_R+M_C$ global latches, configured to store ALU results in the first configuration and the second configuration. The adaptive pipeline controller also includes $M_B$ local latches, configured to store ALU results in the third configuration. A controller is included in the adaptive pipeline controller to combine the values of the $M_R+M_C$ global latches with the $M_B$ local latches to drive a power stage in the digital linear voltage regulator.

Embodiments of the disclosure further provide a controller that may be configured in three states: (1) a bit-wise state, where the $M_B$ local latches are updated one at a time; (2) a column-wise state, where an equivalent total number of $M_B$ latches are updated all at once when a latch in the $M_R+M_C$ global latches is updated; and (3) a row-wise state, where an equivalent total number of $M_C \times M_B$ latches are updated all at once when a latch in the $M_R+M_C$ global latches is updated.

All references, including publications, patent applications, and patents, cited herein are hereby incorporated by reference to the same extent as if each reference were individually and specifically indicated to be incorporated by reference and were set forth in its entirety herein.

The use of the terms "a" and "an" and "the" and "at least one" and similar referents in the context of describing the invention (especially in the context of the following claims) are to be construed to cover both the singular and the plural, unless otherwise indicated herein or clearly contradicted by context. The use of the term "at least one" followed by a list of one or more items (for example, "at least one of A and B") is to be construed to mean one item selected from the listed items (A or B) or any combination of two or more of the listed items (A and B), unless otherwise indicated herein or clearly contradicted by context. The terms "comprising," "having," "including," and "containing" are to be construed as open-ended terms (i.e., meaning "including, but not limited to,") unless otherwise noted. Recitation of ranges of values herein are merely intended to serve as a shorthand method of referring individually to each separate value falling within the range, unless otherwise indicated herein, and each separate value is incorporated into the specification as if it were individually recited herein. All methods described herein can be performed in any suitable order unless otherwise indicated herein or otherwise clearly contradicted by context. The use of any and all examples, or exemplary language (e.g., "such as") provided herein, is intended merely to better illuminate the invention and does not pose a limitation on the scope of the invention unless otherwise claimed. No language in the specification should be construed as indicating any non-claimed element as essential to the practice of the invention.

Preferred embodiments of this invention are described herein, including the best mode known to the inventors for carrying out the invention. Variations of those preferred embodiments may become apparent to those of ordinary skill in the art upon reading the foregoing description. The inventors expect skilled artisans to employ such variations as appropriate, and the inventors intend for the invention to be practiced otherwise than as specifically described herein. Accordingly, this invention includes all modifications and equivalents of the subject matter recited in the claims appended hereto as permitted by applicable law. Moreover, any combination of the above-described elements in all possible variations thereof is encompassed by the invention unless otherwise indicated herein or otherwise clearly contradicted by context.

The invention claimed is:

1. A digital linear voltage regulator comprising:

a power stage, arranged in a hierarchical grouping of power stage units, the power stage configured to deliver power to a load; and a mixed-signal controller, configured to:

control each power stage unit in the power stage, and conditionally adjust a number of active power stage units in the power stage based on a comparison of a feedback voltage of the load and a reference voltage;

wherein the hierarchical grouping of power stage units comprises N levels;

wherein the power stage comprises a number $M_N$ of Nth level units, and an Nth level unit comprising a number $M_N$ of (N−1)th level units; and wherein N is an integer greater than or equal to 3, and $M_N$ and $M_{N-1}$ are integers greater than or equal to 1.

2. The voltage regulator according to claim 1, wherein N=3 and the levels of the hierarchical grouping of power stage units are a first level or "row", a second level or "column", and a third level or "bit";

wherein the power stage comprises $M_R$ rows, a row comprising $M_C$ columns, and a column comprising $M_B$ bits; and wherein $M_R$, $M_C$, and $M_B$ are all integers greater than or equal to 1.

3. The voltage regulator according to claim 2, wherein a bit corresponds to one power stage unit.

4. The voltage regulator according to claim 2, wherein conditionally adjusting the number of active power stage units further comprises:

determining whether each row in the $M_R$ rows should be activated or deactivated, and conditionally activating and deactivating each row accordingly, wherein all power stage units in an activated row deliver power to the load;

selecting a single row in the $M_R$ rows and determining whether each column in the single row should be activated or deactivated, and conditionally activating and deactivating each column accordingly, wherein all power stage units in an activated column deliver power to the load; and selecting a single column in the single row and determining whether each bit in the single column should be activated or deactivated, and conditionally activating and deactivating each bit accordingly, wherein all power stage units in an activated bit deliver power to the load;

wherein all power stage units in activated rows, activated columns, and activated bits are active power stage units.

5. The voltage regulator according to claim 4, wherein the mixed signal controller comprises a pipeline controller, wherein the pipeline controller is configured to use bi-directional data flow to activate and deactivate adjacent rows in the $M_R$ rows, adjacent columns in the single row, and adjacent bits in the single column.

6. The voltage regulator according to claim 5, wherein the pipeline controller comprises $M_R+M_C+M_B$ arithmetic logic units (ALUs); and wherein $M_R$ ALUs are configured to activate or deactivate power stage units in $M_R$ rows, $M_C$ ALUs are configured to activate or deactivate power stage units in $M_C$ columns, and $M_B$ ALUs are configured to activate or deactivate power stage units in $M_B$ bits.

7. The voltage regulator according to claim 6, wherein the mixed signal controller further comprises $M_R \times M_C$ global latches and $M_B$ local latches, wherein the $M_R \times M_C$ global latches store activated and deactivated status for all power stage units based on ALU results from the $M_R$ ALUs and the $M_C$ ALUs, and wherein the $M_B$ local latches store status determined from ALU results from the $M_B$ ALUs.

8. The voltage regulator according to claim 5, wherein the pipeline controller is an adaptive pipeline controller comprising $M_B$ arithmetic logic units (ALUs), where $M_R+M_C \leq M_B$; and wherein in one reconfiguration of the adaptive pipeline controller, $M_R$ ALUs of the $M_B$ ALUs are configured to activate or deactivate power stage units in $M_R$ rows, and in another reconfiguration, $M_C$ ALUs of the $M_B$ ALUs are configured to activate or deactivate power stage units in $M_C$ columns, and in another reconfiguration, the $M_B$ ALUs are configured to activate or deactivate power stage units in $M_B$ bits.

9. The voltage regulator according to claim 8, wherein the adaptive pipeline controller further comprises $M_R+M_C$ global latches and $M_B$ local latches, wherein the $M_R+M_C$ global latches store activated and deactivated status results from the $M_B$ ALUs when reconfigured as $M_R$ ALUs or $M_C$ ALUs, and wherein the $M_B$ local latches store status from the $M_B$ ALUs otherwise.

10. The voltage regulator according to claim 2, wherein each power stage unit is a pass transistor.

11. The voltage regulator according to claim 2, wherein the load is selected from the group consisting of a static load and a switching load.

12. The voltage regulator according to claim 2, wherein the power stage is configured to provide a static voltage or a switching voltage.

13. An adaptive pipeline controller for a digital linear voltage regulator, comprising:

a plurality of arithmetic logic units (ALUs) with bi-directional data flow, configured to compare an input signal with a reference signal, the plurality of ALUs comprising $M_B$ ALUs with three configurations, wherein the plurality of ALUs are reconfigured into a subset of $M_R$ ALUs in a first configuration with $M_R \leq M_B$, a subset of $M_C$ ALUs in a second configuration with $M_C \leq M_B$, and all $M_B$ ALUs in a third configuration, wherein $M_R$ is a total number of rows, $M_C$ is a total number of columns, and $M_B$ is a total number of bits, and wherein a row comprises one or more columns, and a column comprises one or more bits;

$M_R+M_C$ global latches, configured to store ALU results in the first configuration and the second configuration;

$M_B$ local latches, configured to store ALU results in the third configuration; and a controller configured to combine the values of the $M_R+M_C$ global latches with the $M_B$ local latches to drive a power stage in the digital linear voltage regulator.

14. The adaptive pipeline controller of claim 13, wherein the controller is further configured to operate in three states:

a bit-wise state, where the $M_B$ local latches are updated one at a time;

a column-wise state, where an equivalent total number of $M_B$ latches are updated all at once when a latch in the $M_R+M_C$ global latches is updated; and a row-wise state, where an equivalent total number of $M_C \times M_B$ latches are updated all at once when a latch in the $M_R+M_C$ global latches is updated.

15. The adaptive pipeline controller of claim 14, wherein the controller is further configured to use bi-directional data flow to determine the values to be stored in adjacent groupings of $M_R+M_C$ global latches, and adjacent groupings of $M_B$ local latches.

16. The adaptive pipeline controller of claim 13, wherein $M_R+M_C \leq M_B$.

17. A digital linear voltage regulator, comprising:

a power stage, arranged in a hierarchical grouping of power stage units, the power stage configured to deliver power to a load; and a mixed-signal controller, configured to conditionally adjust a number of active power stage units in the power stage based on a comparison of a feedback voltage of the load and a reference voltage;

wherein the hierarchical grouping of power stage units comprises N levels;

wherein the power stage comprises a number $M_N$ of Nth level units, an Nth level unit comprising a number $M_{N-1}$ of (N−1)th level units; and wherein N is an integer greater than or equal to 3, and $M_N$ and $M_{N-1}$ are integers greater than or equal to 1.

18. The voltage regulator according to claim 17, wherein N=3 and the levels of the hierarchical grouping of power stage units are a first level or "row", a second level or "column", and a third level or "bit";

wherein the power stage comprises $M_R$ rows, a row comprising $M_C$ columns, and a column comprising $M_B$ bits; and wherein $M_R$, $M_C$, and $M_B$ are all integers greater than or equal to 1.

19. The voltage regulator according to claim 18, wherein a bit corresponds to one power stage unit.

20. The voltage regulator according to claim 17, wherein each power stage unit is a pass transistor.

* * * * *